US009304473B1

(12) United States Patent
Sugimoto

(10) Patent No.: US 9,304,473 B1
(45) Date of Patent: Apr. 5, 2016

(54) IMAGE FORMING APPARATUS AND CONVEYANCE CONTROL METHOD FOR IMAGE RECEIVING MEDIUM

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Shinya Sugimoto, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/689,150

(22) Filed: Apr. 17, 2015

(51) Int. Cl.
*G03G 15/00* (2006.01)
*B65H 9/00* (2006.01)
*B41J 13/26* (2006.01)

(52) U.S. Cl.
CPC ..... *G03G 15/6564* (2013.01); *G03G 15/6567* (2013.01); *B41J 13/26* (2013.01); *B65H 9/008* (2013.01)

(58) Field of Classification Search
CPC ..... G03G 15/6561; G03G 15/6564; G03G 15/6567; G03G 2215/00561; B41J 13/26; B65H 9/006; B65H 9/008
See application file for complete search history.

(56) References Cited

U.S. PATENT DOCUMENTS

2011/0291353 A1* 12/2011 Fujiwara ..... B65H 3/44 271/258.01

FOREIGN PATENT DOCUMENTS

JP 2013-035688 2/2013

* cited by examiner

*Primary Examiner* — Blake A Tankersley
*Assistant Examiner* — John M Royston
(74) *Attorney, Agent, or Firm* — Amin, Turocy & Watson, LLP

(57) ABSTRACT

In accordance with an embodiment, an image forming apparatus comprises a conveyance roller and a register roller configured to convey an image receiving medium taken out from a paper feed cassette; a rotation detection device configured to detect the backward rotation of the conveyance roller; and a control section configured to stop the rotation of the conveyance roller to align the image receiving medium after the image receiving medium abuts against the register roller that is in a stopped state, restart the rotation of the register roller and the conveyance roller after the aligning process, and control to restart, when the conveyance roller rotates backward during the aligning process, the rotation of the register roller after the conveyance roller is rotated ahead.

10 Claims, 5 Drawing Sheets

IMAGE FORMING APPARATUS AND CONVEYANCE CONTROL METHOD FOR IMAGE RECEIVING MEDIUM

FIELD

Embodiments described herein relate generally to an image forming apparatus which forms an image on an image receiving medium (paper), and a conveyance control method for conveying the image receiving medium by aligning the front end of the image receiving medium.

BACKGROUND

Conventionally, an image forming apparatus takes out a paper in a paper feed cassette through a pickup roller. Further, the paper taken out from the paper feed cassette is guided to a transfer roller through a register roller. To align the positions of the paper and a toner image to be formed on a photoconductive drum, the register roller rotates at given timing, and conveys the paper to a transfer position. The paper passing through the transfer roller is conveyed to a fixing device.

Further, a conveyance roller is arranged at the upstream side of the register roller. The front end of the paper conveyed by the conveyance roller is abutted against the register roller. If the front end of the paper is abutted against the register roller, the paper is bent, thus correcting the skew of the front end of paper.

Incidentally, if the paper to be conveyed is a thin paper, the stretching force of the paper when the paper is bent is small. However, if the paper is a thick paper, since the rigidity of the paper is strong, the stretching force is large. If the stretching force of the paper is large, a returning force that enables the conveyance roller to rotate backward occurs.

At this time, if the idling load of the conveyance roller is stronger than the returning force of the paper, the conveyance roller doesn't rotate backward. However, if the idling load of the conveyance roller is weaker than the returning force of the paper, the idling load is lost to the returning force of the paper, and thus the conveyance roller rotates backward. If the conveyance roller rotates backward, the front end of the paper separates from a nip of the register roller. Thus, the positions of the front end of papers are scattered, which leads to a conveyance failure such as an occurrence of a skew and the like.

DETAILED DESCRIPTION

Figure 1:
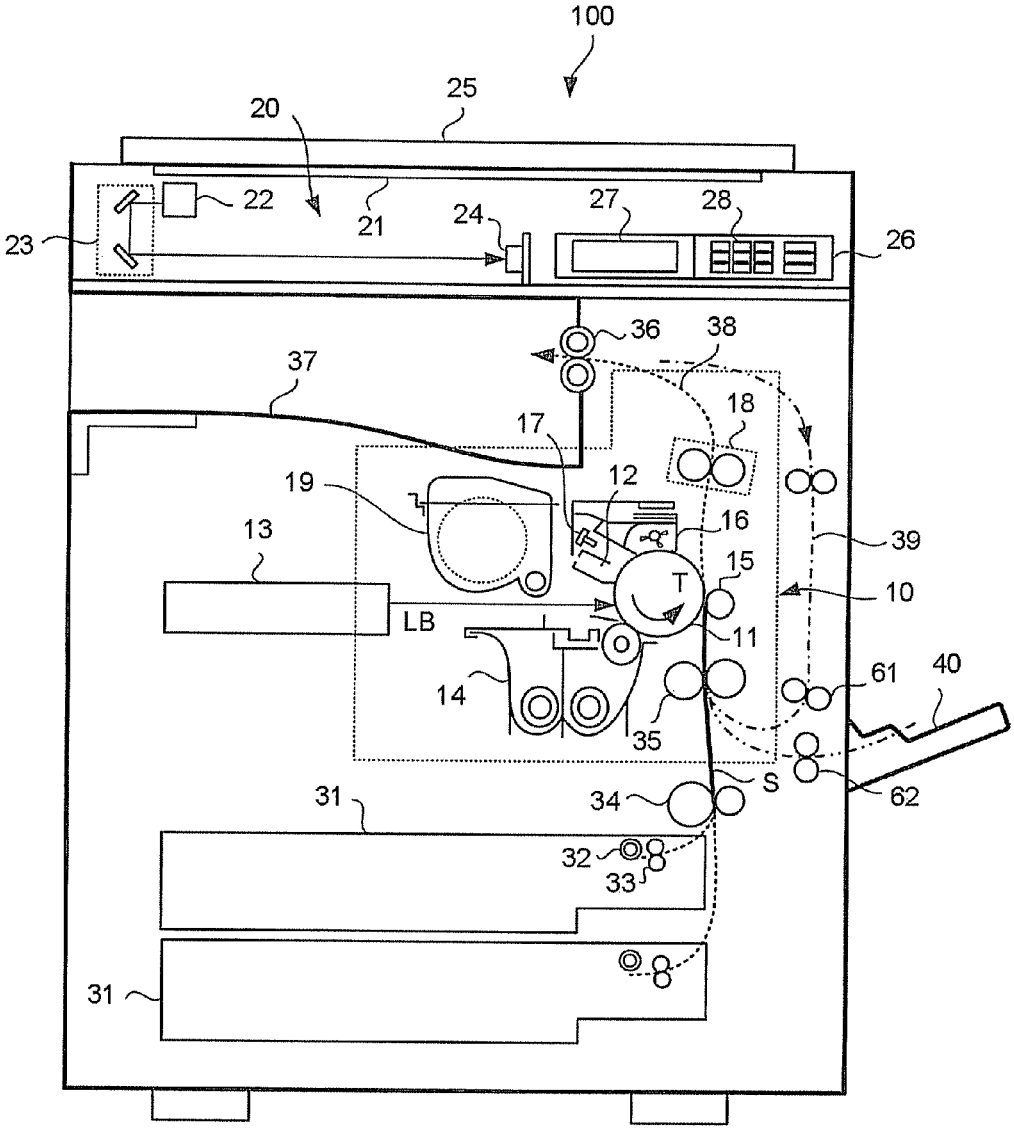
FIG. 1 is a diagram illustrating the constitution of an image forming apparatus according to one embodiment.

In accordance with an embodiment, an image forming apparatus comprises:

a conveyance roller configured to convey an image receiving medium taken out from a paper feed cassette;

a register roller configured to align the front end of the image receiving medium conveyed by the conveyance roller and convey the image receiving medium;

a transfer device configured to transfer an image to the image receiving medium conveyed by the register roller;

a rotation detection device configured to detect the backward rotation of the conveyance roller; and a control section configured to stop the rotation of the conveyance roller to align the image receiving medium after the image receiving medium conveyed by the conveyance roller abuts against the register roller that is in a stopped state, restart the rotation of the register roller and the conveyance roller after the image receiving medium is aligned, and control to restart, when the conveyance roller rotates backward during the aligning process, the rotation of the register roller after the conveyance roller is rotated ahead.

Hereinafter, an image forming apparatus according to the embodiment is described in detail with reference to the accompanying drawings. Further, the same components are applied with the same reference numerals in the drawings, and the description thereof is not provided.

A First Embodiment

FIG. 1 is a diagram illustrating the constitution of an image forming apparatus according to one embodiment. In FIG. 1, an image forming apparatus 100 is an electrophotographic copier. In addition to the copier, the image forming apparatus 100 may be a printer, a MFP (Multi-Function Peripheral) and the like. The copier is exemplified in the following description.

The image forming apparatus (copier) 100 is provided with a printer section 10 at the central part thereof. The printer section 10 is equipped with a photoconductive drum 11 which can rotate freely. The photoconductive drum 11, which is an image carrier, includes an organic photo conductor on the outer periphery. The photoconductive drum 11 is irradiated with light in a state of being applied with given potential. The potential of an area irradiated with light of the photoconductive drum 11 changes and the change of potential is maintained for a given time as an electrostatic latent image.

An electrostatic charger 12, an exposure unit 13, a developer 14, a transfer roller 15, a drum cleaner 16 and a charge removing LED 17 are arranged around the photoconductive drum 11 along a rotation direction T of the photoconductive drum 11.

The electrostatic charger 12 charges the surface of the photoconductive drum 11 to a given potential. The exposure unit 13 exposes the photoconductive drum 11 by irradiating the photoconductive drum 11 with laser beam LB to form an electrostatic latent image on the surface of the photoconductive drum 11. The laser beam LB changes the strength of the light according to the concentration of the image and the like.

The developer 14 stores two-component developing agent including carrier and toner, and supplies the developing agent to the surface of the photoconductive drum 11 to develop the electrostatic latent image of the photoconductive drum 11. The electrostatic latent image on the surface of the photoconductive drum 11 is visualized to form a toner image. The transfer roller 15 constitutes a transfer device.

The transfer roller 15 applies a given potential to a paper S serving as an image receiving medium to transfer the toner image on the photoconductive drum 11 to the paper S. The drum cleaner 16 removes and collects the toner and the like left on the surface of the photoconductive drum 11. The charge removing LED 17 removes the charge left on the photoconductive drum 11.

A fixing device 18 is arranged at the downstream side of the transfer roller 15. The fixing device 18 includes a heat roller and a press roller. The paper S is conveyed between the heat roller and the press roller. The fixing device 18 conveys the paper S in a state of being pressed and heated at a given temperature, in this way, the toner image is fixed on the paper S. Further, a toner cartridge 19 for storing toner is arranged above the developer 14, and if the toner in the developer 14 is consumed, the developer 14 is replenished with toner from the toner cartridge 19.

On the other hand, a scanner section 20 is arranged at the upper portion of the image forming apparatus 100. The scanner section 20 includes an original placing table 21, alight source 22, a reflecting mirror 23 and an image sensor 24. The light source 22 irradiates the original placed on the original placing table 21 with light. The reflecting mirror 23 reflects the light reflected from the original. The image sensor 24 receives the light reflected from the reflecting mirror 23. Further, a original cover 25 is arranged above the original placing table 21 in an openable manner. Moreover, an operation panel 26 is arranged nearby the scanner section 20. The operation panel 26 includes a touch panel type display section 27 and operation keys 28.

A paper feed cassette 31 is arranged at the lower portion of the image forming apparatus 100. A plurality of paper feed cassettes 31 may be arranged according to the size of paper. The paper S (image receiving medium) in the paper feed cassette 31 is guided to a register roller 35 by a pickup roller 32, a paper feed roller 33 and a conveyance roller 34. The paper S guided to the register roller 35 is further guided to the transfer roller 15.

The pickup roller 32 picks up the paper S in the paper feed cassette 31 one by one, and conveys the paper S to the register roller 35. To align the positions of the paper S and the toner image formed on the photoconductive drum 11, the register roller 35 rotates at given timing, and conveys the paper S to a transfer position. The paper S passing through the transfer roller 15 is conveyed to the fixing device 18. The paper S is discharged to a paper discharge tray 37 by a paper discharge roller 36 after it passed through the fixing device 18.

In a case of a simplex printing, the paper S is conveyed from the register roller 35 to the transfer roller 15. The paper S is further conveyed through a conveyance path 38 from the transfer roller 15 to the paper discharge roller 36 via the fixing device 18. Further, a reversal conveyance path 39 used when a duplex printing is carried out is also arranged to be parallel to the conveyance path 38. In a case of a duplex printing, the paper S is temporarily conveyed from the paper discharge roller 36 to the paper discharge section 37. Then the paper S is switched back to be conveyed to the reversal conveyance path 39. The reversal conveyance path 39 is provided with a plurality of conveyance rollers to reverse the paper S and guide it to the register roller 35. Further, a tray 40 for manual feeding is arranged in the image forming apparatus 100. The paper S is inserted from the tray 40 through manually feeding and is guided to the register roller 35.

As stated above, when the register roller 35, the transfer roller 15, the fixing device 18 and the paper discharge roller 36 convey the paper S to the printer section 10, the paper on which an image is formed by the printer section 10 is conveyed to the paper discharge section 37.

During the image forming process of the image forming apparatus 100, the original placed on the original placing table 21 is irradiated with light from the light source 22. The light reflected by the original enters the image sensor 24 through the reflecting mirror 23. Then the image sensor 24 reads an original image. A laser beam LB is output from the exposure unit 13 based on the information read by the image sensor 24 or the image information supplied from an external device such as a PC (Personal Computer) and the like. The laser beam LB is irradiated on the surface of the photoconductive drum 11. The surface of the photoconductive drum 11 is negatively charged by the electrostatic charger 12. Thus, the laser beam LB is irradiated from the exposure unit 13 to expose the photoconductive drum 11, and then the electrostatic latent image is formed on the surface of the photoconductive drum 11.

The electrostatic latent image formed on the photoconductive drum 11 absorbs toner through the developer 14 to be a visible image (toner image). Then if the paper S taken out from the paper feed cassette 31 is conveyed, the toner image on the photoconductive drum 11 is transferred to the paper S by the transfer roller 15. The paper S to which the toner image is transferred is conveyed to the fixing device 18 and heated and pressed by the fixing device 18 to fix the image on the paper S. The paper S on which the image is fixed is discharged to the paper discharge tray 37 through the paper discharge roller 36.

Figure 2:
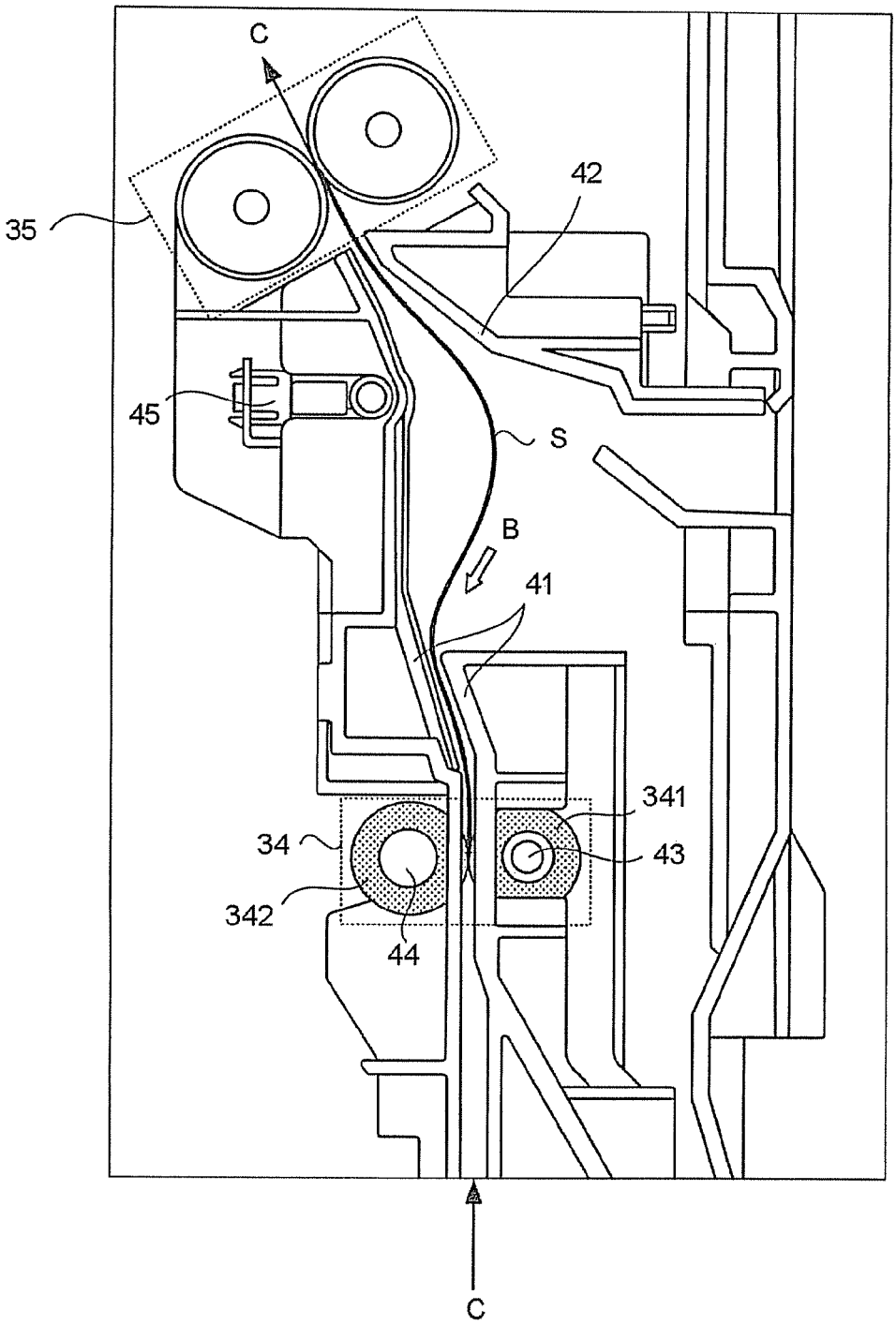
FIG. 2 is a cross-sectional view illustrating a paper conveyance path from a conveyance roller to a register roller according to the embodiment.

FIG. 2 is a cross-sectional view illustrating a paper conveyance path from the conveyance roller 34 to the register roller 35. The conveyance direction of the paper S is indicated by an arrow C.

The conveyance roller 34 is arranged at the upstream side of the register roller 35. A guide 41 is arranged at the conveyance roller 34 side, and a guide 42 is arranged at the register roller 35 side. The paper S is conveyed along the guides 41 and 42 through the rotation of the conveyance roller 34 and the register roller 35.

The conveyance roller 34 consists of a pair of rollers 341 and 342. The rollers 341 and 342 are respectively mounted on shafts 43 and 44. The conveyance roller 34 rotates either one of the shafts 43 and 44 (for example, the shaft 44) through a motor. When the shaft 44 rotates, the roller 342 rotates. In this way, the roller 341 is driven to rotate by the rotation of the roller 342.

Further, a sensor 45 is arranged between the conveyance roller 34 and the register roller 35. The sensor 45 is arranged at a position near the register roller 35. The sensor 45 detects the front end of the paper. The front end of the paper S conveyed from the paper feed cassette 31 is abutted against the register roller 35 through the conveyance roller 34. If a preset specific time elapses from a timing at which the front end of the paper S is detected by the sensor 45, the paper S reaches the register roller 35. When arriving at the register roller 35, the paper S is bent. Thus, it is assumed that the paper S reaches the register roller 35 and is bent when the above-mentioned specific time elapses, and then the conveyance roller 34 stops its rotation temporarily.

The paper S of which the front end abuts against the register roller 35 is bent and aligned. Thus, the conveyance failure such as a skew and the like may be corrected. Moreover, when the front end of the paper S is abutted against the register roller 35, the conveyance roller 34 stops its rotation temporarily. After the skew and the like are corrected, the register roller 35 and the conveyance roller 34 are rotated again (restarted), and the paper S is conveyed towards the transfer roller 15.

Incidentally, when the paper S abuts against the register roller 35, the paper S is bent because the rigidity of the paper S is strong in a case where the paper S is a thick paper, and at this time, a stretching force occurs. When the stretching force of the paper S occurs, a force (returning force B) that enables the conveyance roller 34 to rotate backward occurs. If the idling load of the conveyance roller 34 is stronger than the returning force B of the paper S, the conveyance roller 34 does not rotate backward.

However, in a case in which the idling load of the conveyance roller 34 is weaker than the returning force B of the paper S, the idling load of the conveyance roller 34 is lost to the returning force B, and therefore the conveyance roller 34 rotates backward. When the conveyance roller 34 rotates backward, the front end of the paper that is abutted against the register roller 35 and is aligned separates from a nip of the register roller 35. Thus, the front ends of the papers S are not aligned, the papers S are scattered, and a skew occurs, which causes a conveyance failure.

Figure 3:
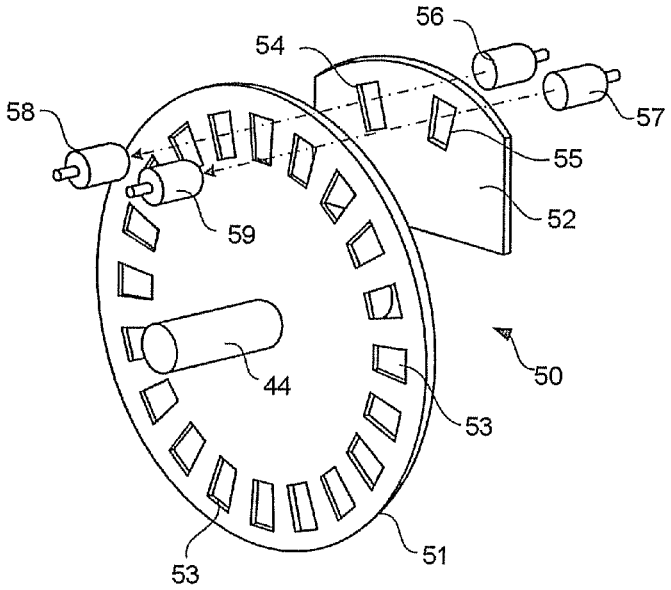
FIG. 3 is a perspective view illustrating the constitution of a rotation detection device for detecting the backward rotation of the conveyance roller according to the embodiment.

In the embodiment, an encoder 50 shown in FIG. 3 is mounted on the shaft 44 of the conveyance roller 34. The encoder 50 is a rotation detection device. The encoder 50 detects the rotation in the forward direction of the conveyance roller 34, and further detects the rotation in the backward direction of the conveyance roller 34.

In FIG. 2, the paper S fed from the paper feed cassette 31 is abutted against the register roller 35 and the front end thereof is aligned. Further, when the specific time elapses after the paper S reaches the register roller 35, the aligning process is completed. The output check of the encoder 50 is started before the aligning process is completed. When the aligning process is completed, the conveyance roller 34 stops. Then, in a case in which the output result of the encoder 50 is confirmed and it is confirmed that there is no backward rotation of the conveyance roller 34, the register roller 35 rotates in response to the image formation just as it is so that the conveyance of the paper S is restarted.

On the other hand, in a case where there is a backward rotation of the conveyance roller 34 according to the output result of the encoder 50, the conveyance roller 34 is rotated a specific time earlier before the register roller 35 is restarted. After the conveyance roller 34 is rotated, the register roller 35 is restarted.

Thus, in a case in which the front end of the paper S is separated from the nip of the register roller 35, the paper S is abutted against the register roller 35 again before the register roller 35 is restarted. In this way, the position of the front end is aligned. As a result, a skew is corrected if the paper S is skew, thus preventing the conveyance failure.

FIG. 3 is a perspective view illustrating the constitution of the encoder 50 serving as the rotation detection device. The encoder 50 includes a rotating plate 51 arranged on the shaft 44 of the conveyance roller 34, and a retaining plate 52 arranged facing the rotating plate 51. A plurality of slits 53 is formed on the rotating plate 51 in the circumferential direction thereof. Two slits 54 and 55 are formed on the retaining plate 52. Further, light emitting elements 56 and 57 are arranged at the external side of the retaining plate 52. The light emitting elements 56 and 57 are opposed to the slits 54 and 55. In addition, light receiving elements 58 and 59 are arranged at the external side of the rotating plate 51. The light receiving elements 58 and 59 are opposed to the light emitting elements 56 and 57.

In FIG. 3, the slit 54 of the retaining plate 52 is set to an A phase, and the slit 55 is set to a B phase. The plurality of slits 53 are formed at equal intervals over the entire circumference of the rotating plate 51. When the shaft 44 rotates, the rotating plate 51 rotates. When the rotating plate 51 rotates, the light from the light emitting elements 56 and 57 that passes through the A phase slit 54 and the B phase slit 55 is transmitted or shielded.

Figure 4:
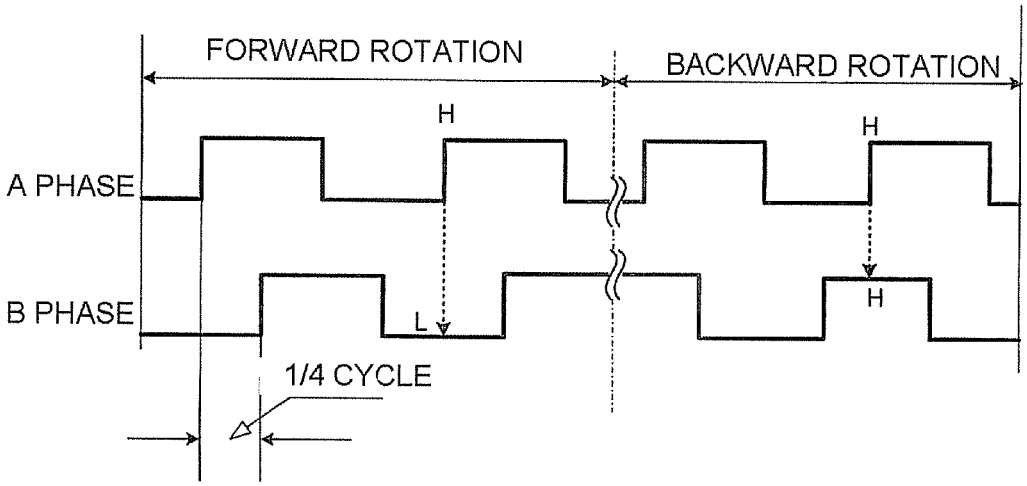
FIG. 4 is a waveform diagram illustrating the operations of the rotation detection device according to the embodiment.

FIG. 4 is a waveform diagram illustrating the operations of the encoder 50 serving as the rotation detection device. In FIG. 4, the light passing through the A phase slit 54 and the light passing through the B phase slit 55 are respectively detected by the corresponding light receiving elements 58 and 59. The detection results of the light receiving elements 58 and 59 are output as two square-wave signals indicated by the A phase and the B phase. The A phase slit 54 and the B phase slit 55 are arranged in such a manner that the phases of the two square-wave signals are deviated from each other by ¼ circle.

In FIG. 4, during the forward rotation, the square-wave signal of the B phase rises ¼ cycle later than the square-wave signal of the A phase does. During the backward rotation, since the rotation direction of the rotating plate 51 is reverse, the B phase rises ¼ cycle earlier than the A phase does. Thus, when the waveform of the A phase rises, it is possible to determine whether it is a forward rotation or a backward rotation by observing whether the waveform of the B phase is HIGH or LOW. That is, when the A phase rises and is HIGH (H), if the B phase falls and is LOW (L), it is determined to be a forward rotation. On the contrary, when the A phase rises and is HIGH (H), if the B phase rises and is HIGH (H), it is determined to be a backward rotation.

Figure 5:
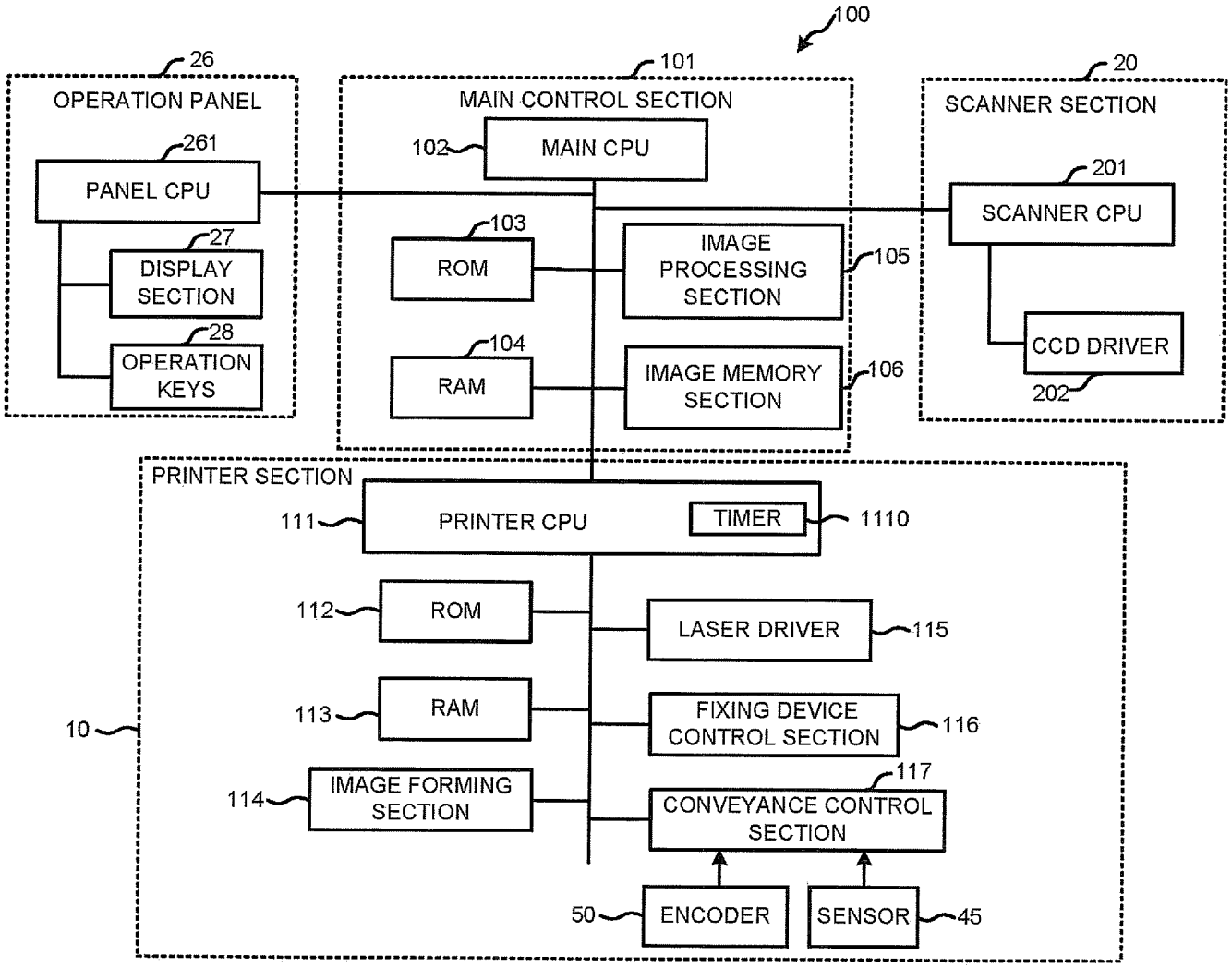
FIG. 5 is a block diagram illustrating the constitution of a control system of an image forming apparatus according to the embodiment.

FIG. 5 is a block diagram illustrating the constitution of a control system of the image forming apparatus 100 according to the embodiment. In FIG. 5, the image forming apparatus 100 comprises a main control section 101, the operation panel 26, the scanner section 20 and the printer section 10. The control system of the image forming apparatus 100 includes a main CPU 102 of the main control section 101, a panel CPU 261 of the operation panel 26, a scanner CPU 201 of the scanner section 20, a printer CPU 111 of the printer section 10, which are communicated with each other.

The main control section 101 includes the main CPU 102, a ROM 103, a RAM 104, an image processing section 105, an image memory section 106 such as a HDD, and the like. The main CPU 102 controls the whole operations of the image forming apparatus 100. Control programs and the like are stored in the ROM 103. The RAM 104 temporarily stores data when the main CPU 102 carries out various processing.

The image processing section 105 processes the image data read by the scanner section 20 and the image data from the PC and the like. For example, the image data processing is an image conversion processing such as enlarging/reducing an image.

The image memory section 106 compresses and stores the image data read by the scanner section 20 and the image data (document data, drawing image data and the like) from the PC. The image data stored in the image memory section 106 is input to the image processing section 105 so that various image processing is performed. The printer section 10 prints image data subjected to image processing on a paper.

The operation panel 26 is provided with the panel CPU 261 that is connected with the main CPU 102, the display section 27 including liquid crystal and the like, and various operation keys 28. The display section 27 has a touch panel function. Instructions of a paper size, a printing magnification, a simplex printing and a duplex printing are input through the display section 27. The operation keys 28 include numerical keys for carrying out an instruction of printing number of copies and the like.

The scanner section 20 comprises a CCD driver 202 that drives the image sensor. The CCD driver 202 drives the image sensor to read an image of an original, and converts the read image into image data.

The printer section 10 is provided with the printer CPU 111, a ROM 112, a RAM 113, an image forming section 114, a laser driver 115, a fixing device control section 116, a conveyance control section 117 and the like. The printer section 10 prints on a paper under the control of the printer CPU 111 through cooperation with the main control section 101.

Programs for controlling the printer section 10 and the like are stored in the ROM 112. The RAM 113, which is a storage section, temporarily stores data when the printer CPU 111 carries out various processing. Further, the printer CPU 111 controls the image forming section 114. The image forming section 114 controls the photoconductive drum 11, the electrostatic charger 12, the developer 14, the transfer roller 15 and the like to form an image. The laser driver 115 drives the laser of the exposure unit 13.

The fixing device control section 116 controls to drive the heat roller of the fixing device 18. The fixing device control section 116 controls the temperature of the heat roller of the fixing device 18.

The conveyance control section 117 controls, under the control of the printer CPU 111, the pickup roller 32 and the paper feed roller 33 to carryout paper feeding control. Further, the conveyance control section 117 controls motors (not shown) that drive the transfer roller 15, the conveyance roller 34, the register roller 35, the paper discharge roller 36 and the like to control the conveyance of the paper S.

The conveyance control section 117 is further connected with the sensor 45 and the encoder 50. The sensor 45 detects the front end of the paper S to be conveyed from the conveyance roller 34 to the register roller 35. The conveyance control section 117 determines, based on the output of the encoder 50, whether the conveyance roller 34 is rotated forward or rotated backward. The conveyance control section 117 rotates, when the conveyance roller 34 is rotated backward, the conveyance roller 34 a specific time earlier before the register roller 35 is restarted. Then, the conveyance control section 117 controls to restart the register roller 35 after the conveyance roller 34 is rotated.

The printer CPU 111 includes a timer 1110. When the conveyance roller 34 is rotated backward, the printer CPU 111 controls to restart the register roller 35 when a given time after the conveyance roller 34 starts to rotate is counted by the timer 1110.

Figure 6:
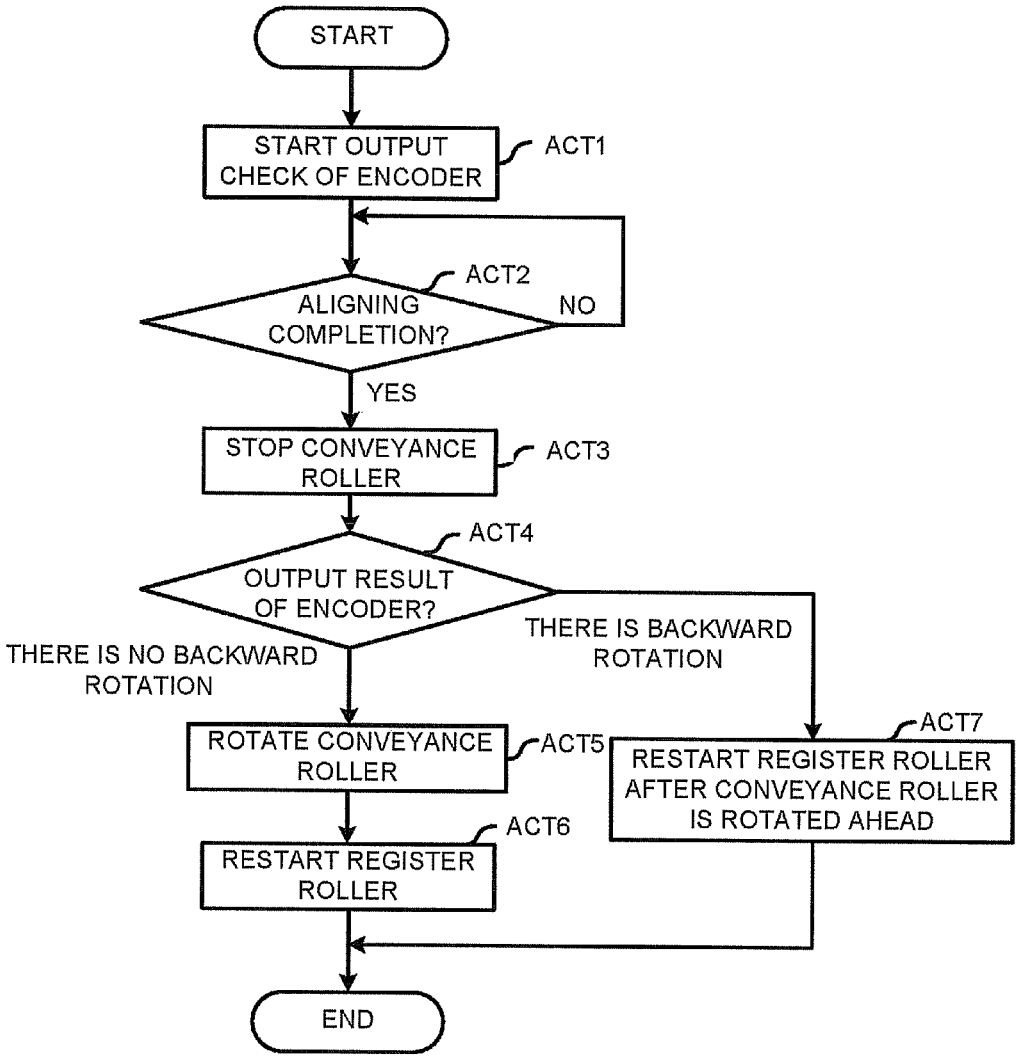
FIG. 6 is a flowchart illustrating the operations of conveyance control of paper according to the embodiment.

FIG. 6 is a flowchart illustrating the operations of conveyance control of paper. The operations in FIG. 6 are executed under the control of the printer CPU 111. Hereinafter, the printer CPU 111 is simply referred to as the CPU 111.

The paper S fed from the paper feed cassette 31 is conveyed to the register roller 35 through the conveyance roller 34. After the front end of the paper S is detected by the sensor 45 and the paper S reaches the register roller 35, the aligning process is completed. That is, after the front end of the paper S is detected by the sensor 45, and the specific time is counted by the timer 1110, the CPU 111 determines that the paper S reaches the register roller 35. The front end of the paper S is abutted against the register roller 35, in this way, a skew correction and the like are carried out.

On the other hand, in ACT 1, the CPU 111 starts an output check of the encoder 50 before the aligning process is completed.

In ACT 2, the CPU 111 determines whether or not the aligning process is completed. That is, after the front end of the paper S is detected by the sensor 45, the elapsed time is counted by the timer 1110. When a preset time elapses after the count process is started, the CPU 111 determines that the aligning process is completed. If the aligning process is completed (YES in ACT 2), the CPU 111 stops the conveyance roller 34 in ACT 3. Then, in ACT 4, the CPU 111 determines the rotation state of the conveyance roller 34 and whether or not the conveyance roller 34 is rotated backward according to the output result of the encoder 50.

In a case in which the CPU 111 determines that there is no backward rotation in ACT 4, the CPU 111 rotates the conveyance roller 34 in ACT 5. Meanwhile, the CPU 111 rotates the register roller 35 to restart it in ACT6.

On the other hand, if it is determined in ACT 4 that there is a backward rotation of the conveyance roller 34, the CPU 111 proceeds to ACT 7. In ACT 7, the CPU 111 controls to rotate the conveyance roller 34 only a time T earlier before the register roller 35 is restarted. After the conveyance roller 34 is rotated, the rotation of the register roller 35 is restarted.

Thus, even in a case in which the conveyance roller 34 is rotated backward and the front end of the paper S is separated from the nip of the register roller 35, the paper S is abutted against the register roller 35 again before the register roller 35 is restarted. The paper S is abutted against the register roller 35 again so that the scattering of the positions of the front end is corrected, and a skew is corrected when generated. In this way, the conveyance failure of the paper S can be prevented.

Further, in ACT 7, the CPU 111 controls to rotate the conveyance roller 34 only the time T earlier before the register roller 35 is restarted, and the time T may be varied in proportion to the backward rotation amount of the conveyance roller 34 detected by the encoder 50. That is, the rotation amount of the conveyance roller 34 that rotates ahead of the register roller 35 is set to be more than the backward rotation amount thereof detected by the encoder 50.

In accordance with the image forming apparatus according to the embodiment described above, even in a case in which the conveyance roller is rotated backward and the front end of the paper is separated from the nip of the register roller, the scattering of the positions of the front end of papers is corrected, a skew is prevented from being generated, and the conveyance failure can be reduced.

Further, the present invention is not limited to the embodiment described above, various applications are possible. For example, it is also possible to apply a case in which the paper is conveyed to the register roller 35 by a conveyance roller 61 (FIG. 1) of the reversal conveyance path 39 to the constitution of the present embodiment. Further, it is also possible to apply a case in which the paper inserted from the manual feeding tray 40 is conveyed to the register roller 35 by a conveyance roller 62 (FIG. 1) to the constitution of the present embodiment. That is, the encoder 50 may be mounted on a shaft of the conveyance roller 61 or a shaft of the conveyance roller 62 to determine the backward rotation of the conveyance roller 61 or the conveyance roller 62, in this way, the conveyance of the paper S may be controlled.

Further, the present embodiment may be applied to an image forming apparatus different from the image forming apparatus as stated in FIG. 1. For example, a quadruple tandem image forming apparatus provided with a plurality of developing units for different colors may be used. Further, a scanning head including LED elements may be used instead of the exposure unit 13.

Further, it is exemplified above that the printer section 10 operates through cooperation with the main CPU 102, and the conveyance control section 117 controls the conveyance of paper and the like under the control of the printer CPU 111. However, the present invention is not limited to this, and the conveyance of paper may be controlled by a single control section (for example, the main CPU 102). Further, the ROM 103 and the RAM 104 of the main control section 101 may be used instead of the ROM 112 and the RAM 113.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a conveyance roller configured to convey an image receiving medium taken out from a paper feed cassette;

a register roller configured to align the front end of the image receiving medium conveyed by the conveyance roller and convey the image receiving medium;

a transfer device configured to transfer an image to the image receiving medium conveyed by the register roller;

a rotation detection device configured to detect that the conveyance roller rotates backwards; and a control section configured to stop the rotation of the conveyance roller to align the image receiving medium after the image receiving medium conveyed by the conveyance roller abuts against the register roller that is in a stopped state, restart the rotation of the register roller and the conveyance roller after the image receiving medium is aligned, and control to restart, when the conveyance roller rotates backward during the aligning process, the rotation of the register roller after the conveyance roller is rotated ahead.

2. The apparatus of claim 1, wherein when there is no backward rotation of the conveyance roller, the control section controls to restart the rotation of the register roller and the conveyance roller at the same time after the image receiving medium is aligned.

3. The apparatus of claim 1, wherein the control section sets, when the conveyance roller is rotated backward during the aligning of the image receiving medium, the rotation amount of the conveyance roller that rotates ahead to be more than the backward rotation amount thereof detected by the rotation detection device.

4. The apparatus of claim 1, further comprising:

a sensor configured to detect the image receiving medium between the conveyance roller and the register roller;

wherein the control section determines the aligning to be completed when a preset time elapses after the front end of the image receiving medium is detected by the sensor, and controls to restart the rotation of the register roller and the conveyance roller.

5. The apparatus of claim 1, wherein the rotation detection device is an encoder which is mounted on a rotation shaft of the conveyance roller to generate different output signals according to the forward rotation and the backward rotation of the conveyance roller.

6. A conveyance control method for an image receiving medium, including:

conveying an image receiving medium taken out from a paper feed cassette to a transfer device through a conveyance roller and a register roller;

detecting that the conveyance roller rotates backwards through a rotation detection device;

stopping the rotation of the conveyance roller to align the image receiving medium after the image receiving medium conveyed by the conveyance roller abuts against the register roller that is in a stopped state; and restarting the rotation of the register roller and the conveyance roller after the image receiving medium is aligned, and controlling to restart the rotation of the register roller after the conveyance roller is rotated ahead when the conveyance roller is rotated backward during the aligning process.

7. The method of claim 6, wherein when there is no backward rotation of the conveyance roller, the rotation of the register roller and the conveyance roller is restarted at the same time after the image receiving medium is aligned.

8. The method of claim 6, wherein when the conveyance roller is rotated backward during the aligning of the image receiving medium, the rotation amount of the conveyance roller that rotates ahead is set to be more than the backward rotation amount thereof detected by the rotation detection device.

9. The method of claim 6, further including:

detecting the image receiving medium through a sensor between the conveyance roller and the register roller; and determining the aligning to be completed when a preset time elapses after the front end of the image receiving medium is detected by the sensor, and restarting the rotation of the register roller and the conveyance roller.

10. The method of claim 6, wherein an encoder mounted on the rotation shaft of the conveyance roller generates different output signals according to the forward rotation and the backward rotation of the conveyance roller.

* * * * *